US012799743B2

(12) United States Patent
Jávori et al.

(10) Patent No.: US 12,799,743 B2
(45) Date of Patent: Nov. 17, 2026

(54) MODULAR WALL STRUCTURE

(71) Applicant: SENSONIC DESIGN IRELAND LIMITED, Dublin (IE)

(72) Inventors: Dávid Vilmos Jávori, Budapest (HU); Kristóf Bukovácz, Budapest (HU); Georgina Budai, Budapest (HU)

(73) Assignee: SENSONIC DESIGN IRELAND LIMITED, Dublin (IE)

( * ) Notice: Subject to any disclaimer, the term of this patent is extended or adjusted under 35 U.S.C. 154(b) by 58 days.

(21) Appl. No.: 19/102,383

(22) PCT Filed: Aug. 8, 2023

(86) PCT No.: PCT/EP2023/071982
§ 371 (c)(1),
(2) Date: Feb. 8, 2025

(87) PCT Pub. No.: WO2024/033384
PCT Pub. Date: Feb. 15, 2024

(65) Prior Publication Data

US 2026/0055614 A1 Feb. 26, 2026

(30) Foreign Application Priority Data

Aug. 9, 2022 (EP) ..... 22462008

(51) Int. Cl.
*E04F 13/08* (2006.01)

(52) U.S. Cl.
CPC ..... *E04F 13/0808* (2013.01); *E04F 13/0816* (2013.01)

(58) Field of Classification Search
CPC ..... G09G 2300/026; E04F 13/0855; E04F 13/08; E04F 13/0801; E04F 13/0807;
(Continued)

(56) References Cited

U.S. PATENT DOCUMENTS 12,385,598 B2 * 8/2025 Meersman ..... E04B 1/34
12,400,563 B1 * 8/2025 Kim ..... G09F 9/302
(Continued)

*Primary Examiner* — Joshua J Michener
*Assistant Examiner* — Henry Hooper Mudd
(74) *Attorney, Agent, or Firm* — Daniel S. Kim

(57) ABSTRACT

The modular wall structure comprises multiple primary frames (10) for carrying cladding elements (11) and building service devices (12); a secondary frame (20) for supporting the primary frames (10); and a moving system for moving each primary frame (10) with respect to the secondary frame (20) in six degrees of freedom. The moving system comprises at least three moving units (40) for each primary frame (10). Each moving unit (40) comprises a housing (50) attached to the primary frame (10); a spherical joint bushing (61) inside the housing (50), wherein said joint bushing (61) can be translated parallel to the plane of the primary frame (10); a first drive unit (72) attached to the primary frame (10) for moving the ball joint bushing relative to the housing (50) along a first direction (x) by means of a first shaft (70); a second drive unit (82) attached to the primary frame (10) for moving the ball joint bushing relative to the housing (50) along a second direction (y) perpendicular to the first direction (x) through a second axis (80); and a third drive unit (92) attached to the secondary frame (20) for moving the ball joint bushing relative to the secondary frame (20) in a third direction (z) perpendicular to both the first direction (x) and the second direction (y), through a third shaft. A free end of the first shaft (70) is slidably mounted into a first guide groove of the ball joint bushing, said first guide groove (62) extending in the second direction (y). A free end of the second shaft is slidably mounted in a second guide groove of the ball joint bushing, said second guide groove extending in the first direction (x). A free end of the third shaft is mounted into a ball joint rotatably arranged in said ball joint bushing.

6 Claims, 4 Drawing Sheets

(58) Field of Classification Search
CPC ... E04F 13/0808; E04F 13/0816; E04F 13/25; E04C 2002/001; G09F 9/3026; E04B 2/74
USPC ..... 52/29, 64
See application file for complete search history.

(56) References Cited

U.S. PATENT DOCUMENTS

| | | | | |
|---|---|---|---|---|
| 2024/0328169 | A1* | 10/2024 | Puchol | E04F 13/08 |
| 2025/0207408 | A1* | 6/2025 | Rouif | E04F 13/24 |

* cited by examiner

MODULAR WALL STRUCTURE

This is the national stage of International Application PCT/EP2023/071982, filed Aug. 8, 2023.

The present invention relates to a modular wall structure, in particular a wall structure suitable for holding building service devices and electronic devices.

Currently, in the construction industry, indoor building service devices and electronic devices are installed in the structurally ready building at the last stage of the construction process. After the installation of the building service devices and the electronic devices, the covering elements are placed on the wall structure, which on the one hand, hide the mentioned devices from the user, and on the other hand, they also have an aesthetic function. During installation in several steps, the positioning and alignment of individual elements is often inaccurate, and the position of the installed elements cannot be changed. One possible way to remedy this problem is to use a wall structure, the independent elements of which can be freely positioned relative to each other.

The patent document DE 102013109897 A1 describes a modular wall structure that consists of a so-called primary frame and a secondary frame connected thereto. The primary frames are equipped with a decorative layer and a magnetic element. The secondary frame is equipped with a magnetic element of opposite polarity to fix the primary frames magnetically. The secondary frame can be attached to a load-bearing wall. Building service cables/pipes can be placed in the channels formed in the primary frames. Due to the magnetic fixation, the individual primary frames can be freely positioned within certain limits in relation to the secondary frame, so that they can be removed in one step with the building service cables/pipes. The disadvantage of the solution is that the position of the primary frames relative to the secondary frame can only be changed manually and only along the magnetic connection surface.

The patent document DE 102004052367 A1 describes a wall structure that includes several primary frames that are provided with cladding elements. The primary frames are connected to a secondary frame made of profiled rods that can be attached to a load-bearing wall via a moving hinge system, which enables the individual primary frames to move in six degrees of freedom relative to the secondary frame. The disadvantage of this solution is that the movement of the moving hinge system cannot be remotely controlled, so setting the desired position of the primary frames in the case of a large number of primary frames is extremely cumbersome and time-consuming.

The patent document US 2022/0022330 A1 describes a tile-like wall structure that includes several primary frames for carrying displays. The individual primary frames are connected to a secondary support frame that can be attached to the load-bearing wall through a moving structure, which enables the individual primary frames to move with six degrees of freedom relative to the secondary frame. The movement of the individual primary frames in a plane parallel to their plane is motorized and can be remotely controlled, however, their angular position relative to the secondary support structure can only be adjusted manually.

The object of the present invention is to provide a modular wall structure that enables the installation of cladding elements and building service elements in one step, as well as the remotely controlled and coordinated high-precision positioning of the primary frames holding the cladding elements.

The above objects are achieved by providing a modular wall structure according to claim 1. Preferred embodiments of the modular wall structure according to the invention are defined by the dependent claims.

The invention will now be described in detail with reference to the accompanying drawings, in which FIG. 1.A is an exploded perspective view of the modular wall structure according to the invention;

FIG. 1.B illustrates the primary frame and the moving system of the modular wall structure according to the invention in a perspective view;

FIG. 1.C is a side view of the modular wall structure according to the invention;

Figure 1A:
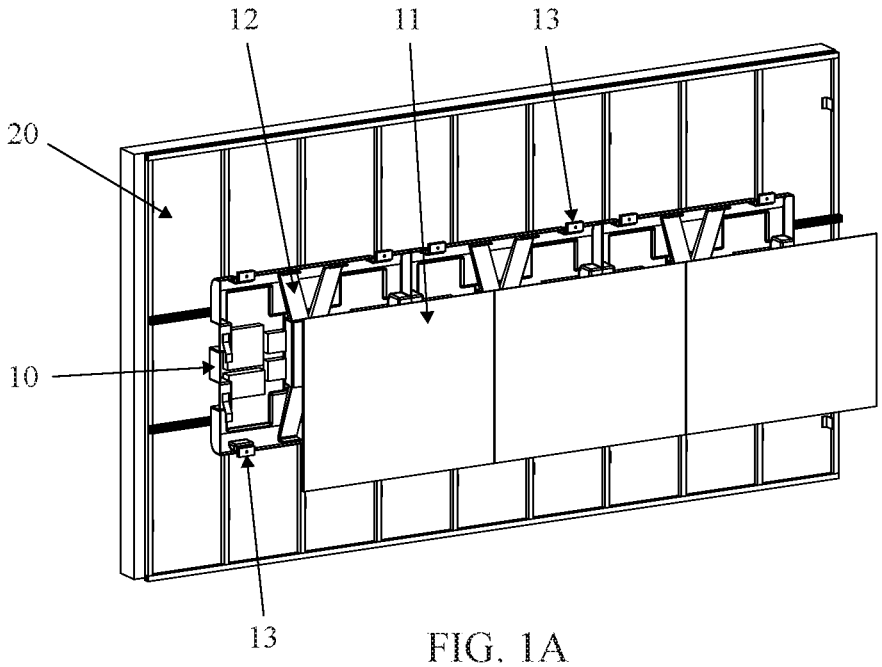
Figure 1B:
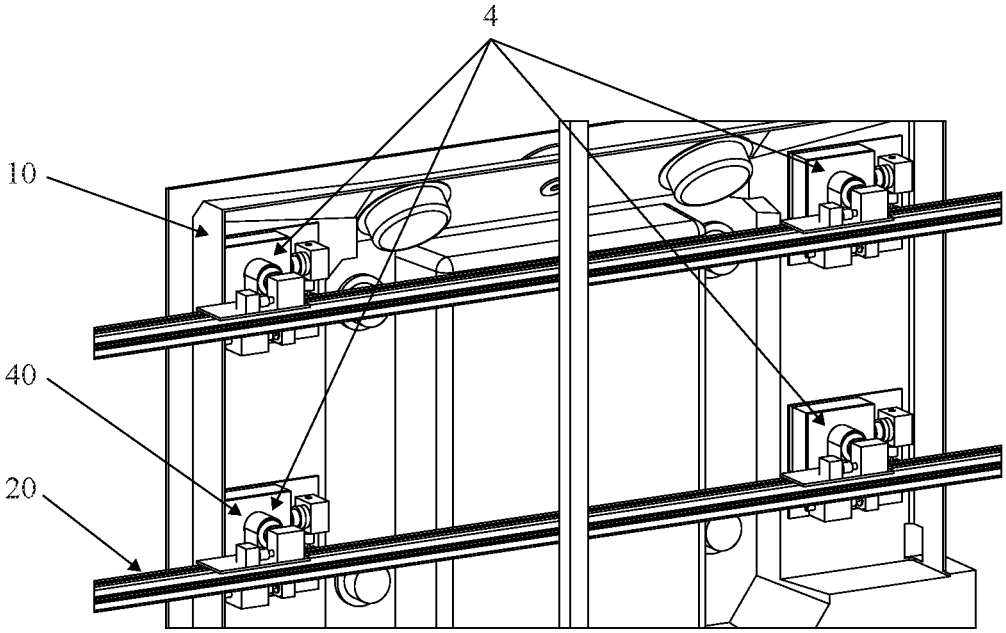
Figure 1C:
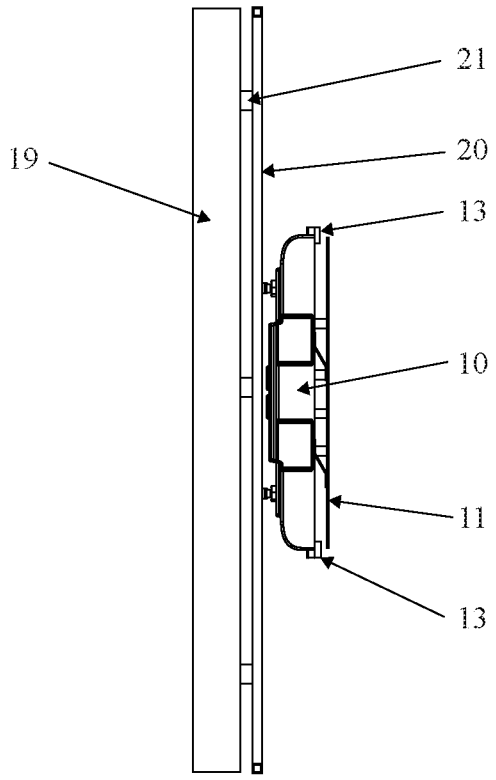

The modular wall structure according to the invention will be described in the present description through a preferred embodiment, the different views of which are illustrated in the attached drawings. FIG. 1.A shows the design of the modular wall structure according to the invention. The modular wall structure contains several primary frames 10 for carrying cladding elements 11 and building service devices 12. The primary frames 10 are also suitable for holding other devices, such as electronic devices (especially speakers, cameras, sensors, lasers, etc.), however, for the sake of simplicity, such devices are also referred to as building service devices in the present description.

The individual primary frames 10 are connected to a secondary frame 20 that can be attached to a static load-bearing wall or internal partition wall of the building, for example made of profiled bars, through a moving system 4 that enables the individual primary frames 10 to be moved in six degrees of freedom relative to the secondary frame 20. On their front side facing the secondary frame 20 (on the so-called mounting side), the primary frames 10 are preferably provided with fastening elements that are used to fasten the building service devices 12 (and/or electronic devices). On their sides opposite to said first sides (i.e. on the sides facing the interior of the premises) are preferably provided with fixing elements for fixing the cladding elements 11.

As shown in FIG. 1.B, the moving system 4 is located on the first side of the primary frame 10 facing the secondary frame 20. The moving system 4 of each primary frame 10 comprises at least three, preferably four moving units 40, which are preferably located in the corner regions of the rectangular (or optionally square) shaped primary frame 10.

As shown in FIG. 1.C, the secondary frame 20 is provided with fastening elements 21 with which it can be attached to a wall 19 of the building, for example a static load-bearing wall or an internal partition wall.

Figure 2:
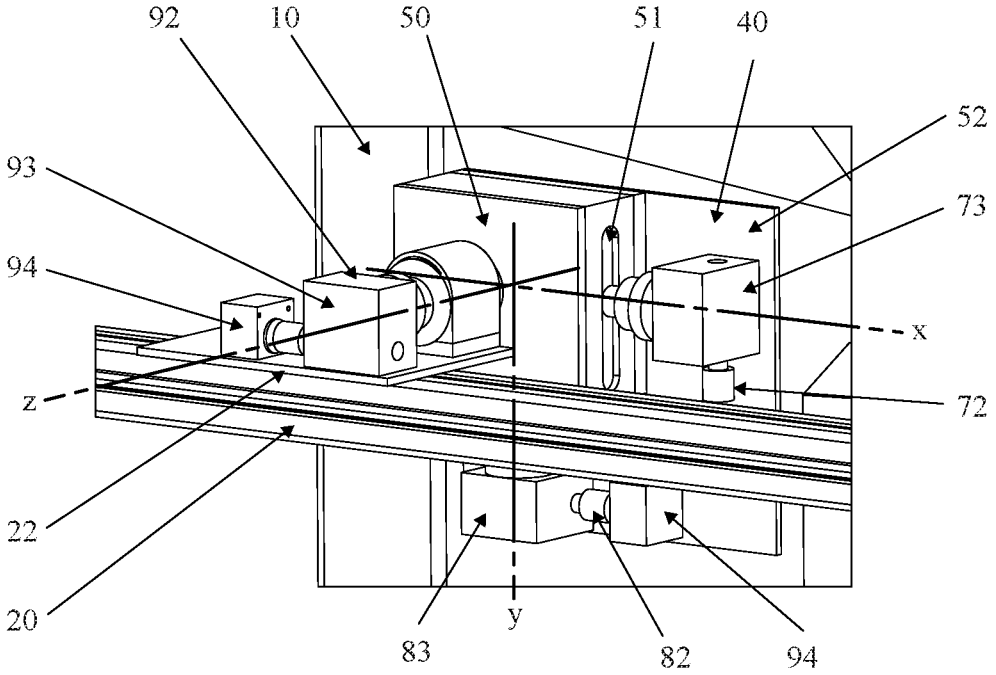
FIG. 2 is a perspective view of the moving unit according to the invention.
Figure 3:
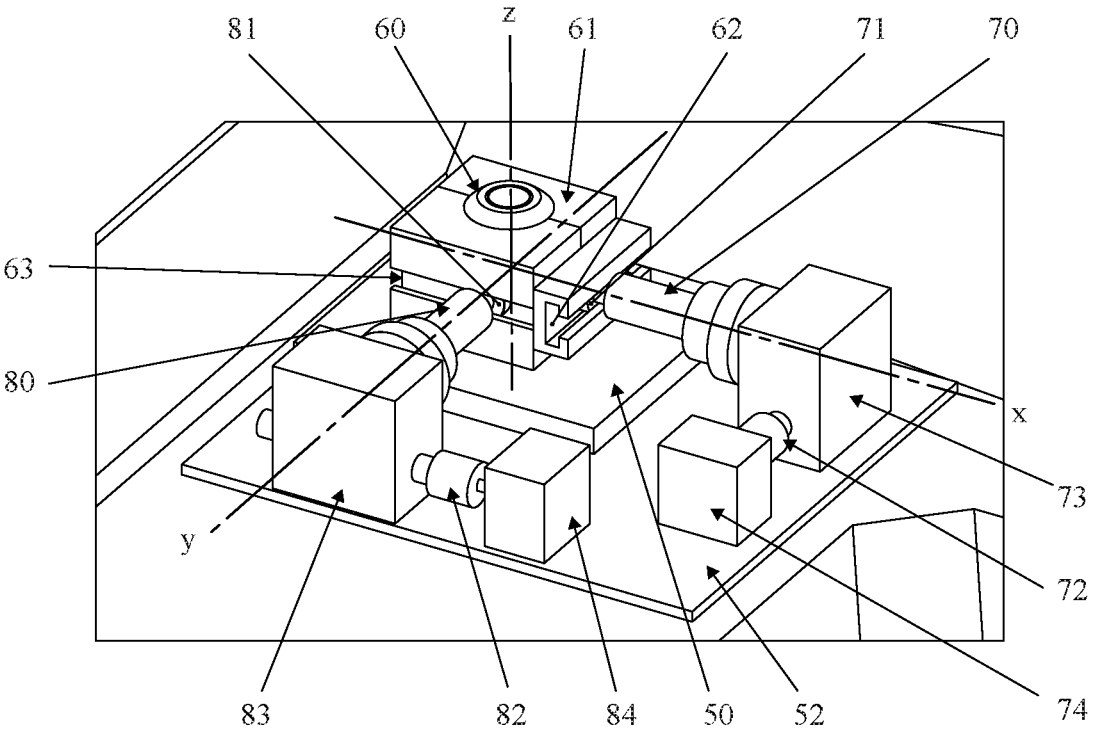
FIG. 3 illustrates the moving unit according to the invention in a perspective view without the side wall of the housing.
Figure 4:
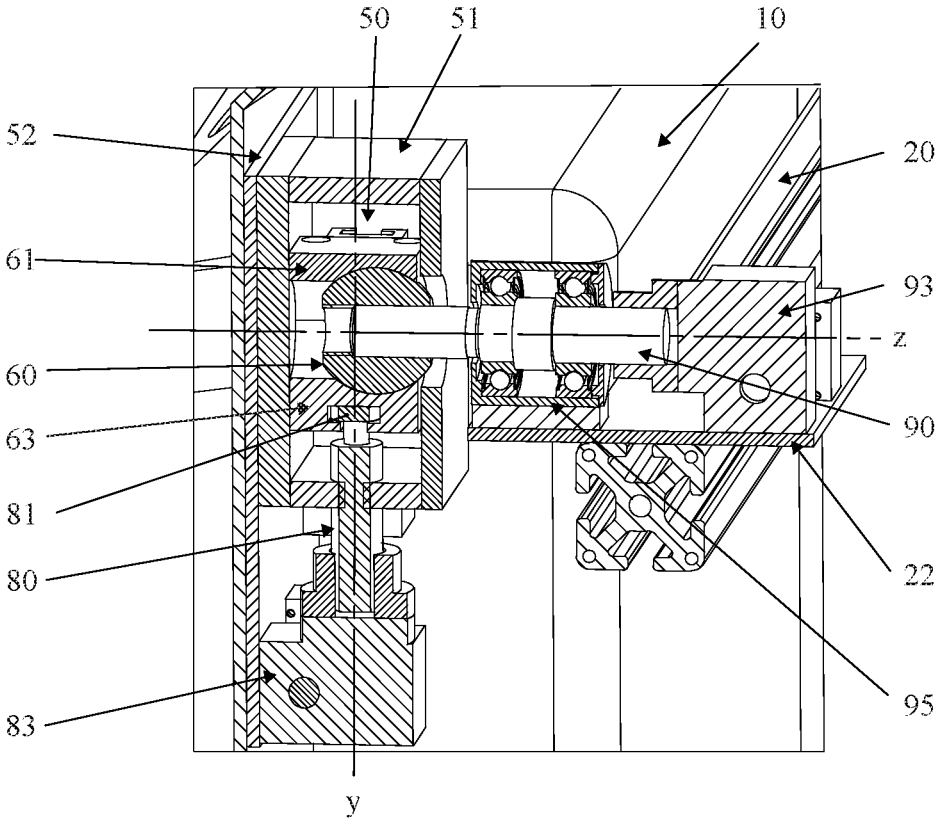
FIG. 4 is a perspective cross-sectional view of the moving unit according to the invention.

FIGS. 2 to 4 illustrate the arrangement of the main elements of the moving unit 40 in different views in a preferred embodiment of the modular wall structure according to the invention. The moving unit 40 contains a housing 50 attached to the primary frame 10, which has two walls parallel to the plane of the primary frame 10 and side walls 51 perpendicular to the plane of the primary frame 10. Inside the housing 50 a ball joint bushing 61 is arranged which can be moved in any direction parallel to the plane of the primary frame 10 inside the housing 50. The enclosing dimensions of the ball joint bushing 61 are smaller than the internal dimensions of the housing 50.

The moving unit 40 includes a first driver 72 attached to the primary frame 10, said first drive unit 72 being configured to move the ball joint bushing 61 through a first shaft 70 along a first direction relative to the housing 50, in this case parallel to an x-axis shown in FIG. 2, and a the second drive unit 82 fixed to the primary frame 10, said second drive unit 82 being configured to move the ball joint bushing 61 through a second shaft 80 relative to the housing 50 along a second direction perpendicular to the first direction, in this case parallel to an y-axis shown in FIG. 2. The moving unit 40 also includes a third drive unit 92 fixed to the secondary frame 20, said third drive unit 92 being configured to move the ball joint bushing 61 a third shaft 90 relative to the secondary frame 20 along a third direction perpendicular to both of the first direction and the second direction, in this case parallel to a z-axis shown in FIG. 2.

The free end of the first shaft 70 is held in a groove 62 formed on the side wall 51 of the housing 50 facing the shaft 70 and running parallel to the y-axis. In a similar way, the free end of the shaft 80 is held in a groove 63 formed on the side wall 51 of the housing 50 facing the shaft 80 and running parallel to the x-axis. Each drive unit 72, 82, and 92 preferably has a respective self-locking, worm gear unit 73, 83, 93 having a gear ration of 1:50, for example, and further has a stepper motor 74, 84, 94, respectively. The first drive unit 72 can move the first shaft 70 in a first direction parallel to the x-axis, and the second drive unit 82 can move the second shaft 80 in a second direction parallel to the y-axis along a straight line. The third drive unit 92 rotates the third shaft 90 parallel to the z-axis in such a way that the ball joint bushing 61 in the housing 50 moves relative to the secondary frame 20 along the third direction parallel to the z-axis.

In a preferred embodiment of the modular wall structure according to the invention, as it can be seen in particular in FIG. 2, the housing 50, the first drive unit 72 and the second drive unit 82 are fixed to a support plate 52 mounted on the first side of the primary frame 10 facing the secondary frame 20, said support frame 52 extending parallel to the plane of the primary frame 10, whereas the third drive unit 92 is mounted on a horizontal bracket 22 attached to the horizontal profile bar of the secondary frame 20.

FIG. 3 illustrates the design of the moving unit 40, in particular the design of the ball joint bushing 61. A first guide groove 62 extending in the second direction and a second guide groove 63 extending in the first direction are formed on the ball joint bushing 61. The free end 71 of the first shaft 70 is slidably clamped into the first guide groove 62, whereas the free end 81 of the second shaft 80 is slidably clamped into the second guide groove 63.

As it can be seen in the cross-sectional view in FIG. 4, the ball joint bushing 61 has a ball joint 60 freely rotatable in multiple directions. In the embodiment shown in the drawings, the third shaft 90 is connected to the ball joint 60 with screw threads. To move the housing 50 along a third direction parallel to the z-axis, the third drive unit 92 can rotate the third shaft 90 in one place. The section of the shaft 90 between the third drive unit 92 and the ball joint 60 is preferably supported by a load bearing guide 95, such as a bearing, attached to the bracket 22 as shown in FIG. 4.

Figure 5:
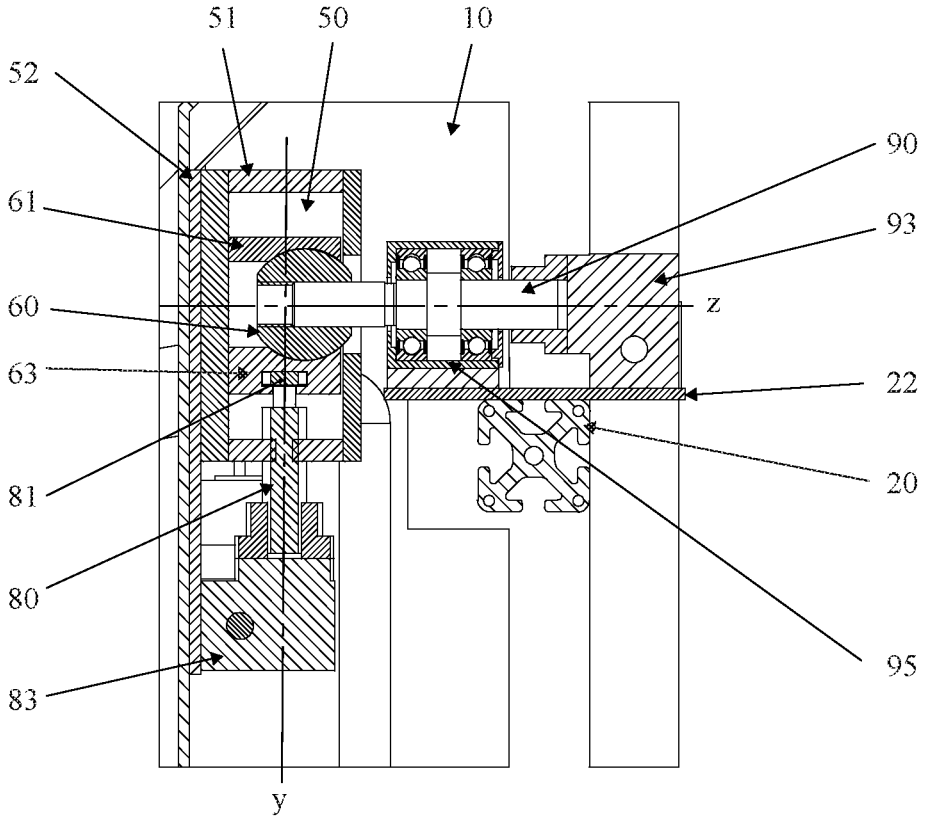
FIG. 5 illustrates the moving unit according to the invention in a cross-sectional view during a cycle of moving the primary frame along a straight line in a third direction.
Figure 6:
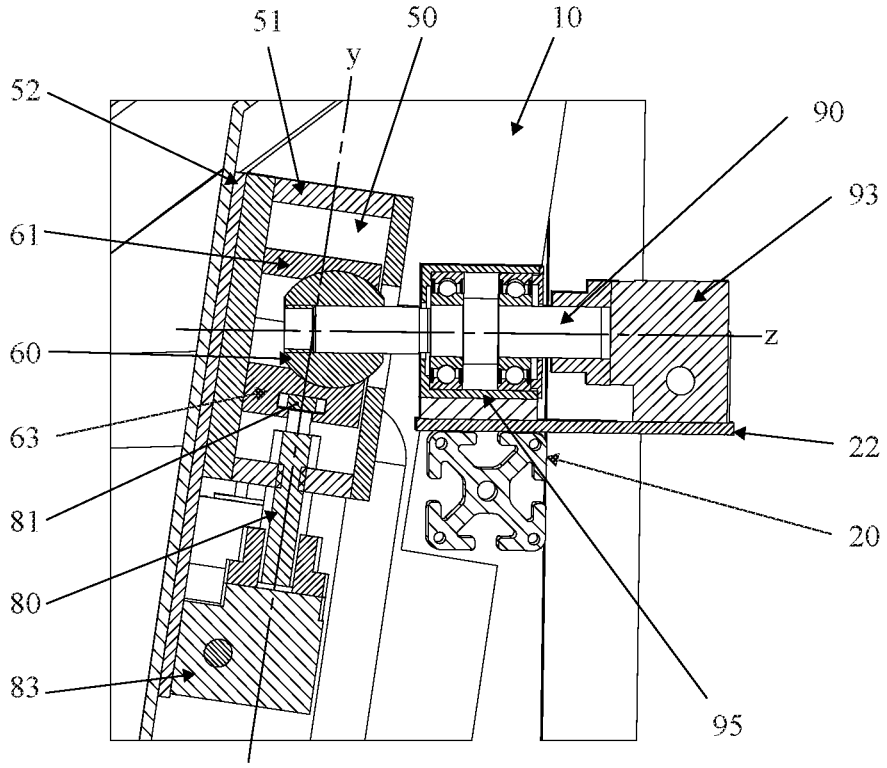
FIG. 6 illustrates the moving unit according to the invention in a cross-sectional view during the adjustment of the angle of inclination defined by the plane of the primary frame and the plane of the secondary frame.

Below the operation of the 4 moving systems is described with reference to FIGS. 5 and 6. Through the appropriate control of each moving unit 40, the moving system 4 is adapted for rotating each primary frame 10 around three mutually perpendicular axes, as well as linearly displacing the primary frames 10 along said three mutually perpendicular axes, i.e. their positioning with six degrees of freedom, relative to the secondary frame 20.

The first shaft 70 and the first drive unit 72 of the individual moving units 40 forming the moving system 4 allow the linear movement of the individual primary frames 10 in the first direction, and the second shaft 80 and the second drive unit 82 allow the linear movement of the individual primary frames 10 in the second direction. The first shaft 70 and the second shaft 80, together with their respective drive units 72, 82 cooperate to rotate each primary frame 10 around the axis of third direction.

During the linear movement of the primary frame 10 in the first direction, the first drive unit 72 of each of the moving units 40 of the moving system 4 move the first shaft 70 in the first direction at the same speed. At this time, the free end 71 of the shaft 70 rests on one surface of the guide groove 62, and the first drive unit 72 and the housing 50 attached thereto moves parallel to the plane of the primary frame 10, in the first direction, along a straight line relative to the ball joint bushing 61 located in the housing 50. Consequently, the primary frame 10 moves along a straight line relative to the secondary frame 20 in the first direction. Meanwhile, the free end 81 of the shaft 80 moves in the first direction (i.e. parallel to the x-axis) in the second guide groove 63. Similarly, while moving the primary frame 10 along a straight line in the second direction, the second drive unit 82 of each moving unit 40 of the moving system 4 moves the second shaft 80 in the second direction, along a straight line, at the same speed. Then, the free end 81 of the shaft 80 rests on one surface of the guide groove 63, and the second drive unit 82 and the housing 50 attached to it move parallel to the plane of the primary frame 10, in the second direction parallel to the y-axis, along a straight line, relative to the ball joint bushing 61 located in the housing 50. Consequently, the primary frame 10 moves along a straight line relative to the secondary frame 20 in the second direction. Meanwhile, the free end 71 of the shaft 70 moves in the second direction (i.e. parallel to the y-axis) in the first guide groove 62.

During the rotation of the primary frame 10 around the z-axis, the first drive unit 72 of at least one moving unit 40 and the second drive unit 82 of at least one moving unit 40 of the moving system 4 move the first shaft 70 in the first direction and the second shaft 80 in the second direction, thereby the primary frame 10 rotates with respect to the secondary frame 20.

At the end of a given motion cycle, the drive unit 72 and the drive unit 82 are configured to stop. By means of the self-locking worm gear units 73, 83, the shaft 70 and the shaft 80 are locked, which further prevents the shafts 70 and 80 from moving in the first and second directions, respectively. In this way, the position of the housing 50 relative to the ball joint bushing 61 and, consequently, the position of the primary frame 10 relative to the secondary frame 20 becomes fixed.

The third shaft 90 rotatably engaged with the ball joint 60 arranged in the ball joint bushing 61, and the third drive unit 92 allow the linear movement of the individual primary frames 10 along the third direction parallel to the z-axis, as well as their rotation around the first and second axes, i.e. the adjustment of the tilt angle of the primary frame 10 relative to the secondary frame 20.

During the linear movement of the primary frame 10 in the third direction, the drive unit 92 of each moving unit 40 of the moving system 4 rotates the third shaft 90 at the same speed. Then the ball joints 60, which are connected to the individual shafts 90 through screw threads, make an equal amount of progressive movement along the direction of the third shafts 90. Consequently, as shown in FIG. 5, the ball joint bushing 61 and the primary frame 10 mounted stationary relative to the ball joint bushing 61 move relative to the secondary frame 20 along a straight line in a third direction parallel to the z-axis.

During the adjustment of the tilt angle of the primary frame 10, the drive units 92 of the moving units 40 of the moving system 4 rotate the third shafts 90 at different speeds. In this case, each ball joint 60 performs a different amount of progressive movement along each third shaft 90. Consequently, as shown in FIG. 6, the ball joint bushing 61 rotates relative to the ball joint 60. The primary frame 10, which is stationary relative to the ball joint bushing 61, thus rotates around an axis in the first direction and/or the second direction, i.e. the plane of the primary frame 10 tilts in one or two directions, at a given angle, relative to the plane of the primary frame 20.

At the end of a given movement cycle, the drive unit 92 stops. Due to the self-locking worm gear 93, the shaft 90 is no longer able to rotate, thus the position and the tilt angle of the primary frame 10 in the third direction becomes fixed with respect to the secondary frame 20.

The drive units 72, 82, 92 of the moving system 4 of the modular wall structure according to the invention can be controlled individually by means of a central computer via conventional signal lines. The individual control of the drive units 72, 82, 92 allows individual positioning of each primary frame 10 relative to the secondary frame 20 in six degrees of freedom. The positioning of the individual primary frames 10 can be carried out individually, independently of each other, and by using a suitable computer program, simultaneous positioning of the 10 primary frames may be carried out in a coordinated manner. In the latter case, the positioning errors that occur during the installation of the modular wall structure can be completely eliminated and the flat tiles attached to the primary frames 10 can be aligned perfectly in one plane, and the tiles with a curved or other three-dimensional surface can be placed with high precision to align with the desired three-dimensional surface (e.g. cylindrical column, arch, etc.). For the purpose of connecting to the central computer, connectors can be formed either on the primary frame 10 or on the secondary frame 20, to which the signal lines from the central computer can be connected, i.e. the central computer that controls the operation of the drive units does not necessarily form part of the modular wall structure according to the invention.

In a particularly preferred embodiment of the modular wall structure according to the invention, as shown in FIG. 1.C, the primary frame 10 may be equipped with distance-measuring sensors 13 on its second side facing the interior of the premises. The sensors 13 may be connected to a central computer via signal lines. The distance-measuring sensors 13 may include, for example, laser-type distance measuring sensors. The distance-measuring sensors 13 measure the distance between the primary frame 10 and a reference object placed in the space volume in front of the modular wall structure and transmit the measurement data via signal lines to the central computer, which, based on the measurement data, calculates the displacement distances and rotational angles required for the positioning of each primary frame 10 and, depending on them, sends corresponding control signals to all driving units of the individual moving units, which must participate in the positioning of the given primary frame 10.

Next, the main steps of the on-site installation of the modular wall structure according to the invention are described.

A fastening system is built on the static load-bearing wall structure of the building or on the interior division wall, for example a lightweight wall, which ideally consists of a custom-made aluminum profile.

The fastening system is attached to the wall vertically and horizontally by means of screws and/or glue, using the necessary spacers. The floor, the ceiling, or, if provided, a static wall in the given premises are used as fixing points. The depth of the fastening system is typically 30-400 mm. In this depth range, there is usually enough space for the entire building service system (e.g. cable bundles, pipelines, plumbing fittings, air conditioners, air exchange systems, power rails, bus connectors, fiber optic units, etc.).

After the installation of the fastening system, the secondary frame is built, which carries the primary frames and the additional building service devices, entertainment electronics, health-care devices, etc. attached to them, as well as the decorative cladding elements. The secondary frame functions to provide a load-bearing connection between the building's masonry and the primary frames. The secondary frame is structurally composed of two main units, namely a wall bracket (e.g. Eurofox) and shaped aluminum profiles. The secondary frame is usually a custom-designed and custom-made unit. The secondary frame has the smallest possible front surface so that the above mentioned building service devices (e.g. air conditioners, plumbing fittings, etc.) fit behind it and can be connected as simply as possible to the devices attached to the primary frame.

The primary frames are preferably made of carbon fiber composite material. The primary frame is suitable for mounting, among others, the following devices: liquid audio exciters and the related additional resonant systems, auxiliary audio exciters, electronic control units, signal amplifiers, power supplies, as well as heating/cooling systems, camera systems, LIDAR units, ultrasound sensors, infrared cameras, electronic assembly boxes, mechatronic units of the servo motors moving the primary frame, air conditioning equipment, other building service units, entertainment electronic devices, fire protection units, integrated GIS lasers and other sensors, as well as Med-Tech devices, like UWB-SAR radar, ultrasound systems, infrared matrices, electrocardiogramatems, vo2 systems, etc.

The final cladding elements (visible to the user even after installation) are preferably glued to a plate made of spring steel, which serves as a safety element in the event of breakage or damage to the cladding. When installing audio exciters, it is important that the carrier plate of the tiles should be flexible since the vibration of the audio exciters must reach the tiles without any damping.

Preferably, at the edges of the tiles attached to the primary frames, there are invisible joints, through which the above-mentioned sensors and cameras can see the given room or building space where the system has been installed.

The air inlet ducts of the air conditioner and the heating system are preferably placed at the top and the bottom of the entire modular wall structure. These channels may be made by 3D printing according to the unique size of the wall panel. The air ducts are preferably attached to the primary frames by a flexible resin-based adhesive and a through bolt.

The heating filaments used for heating are preferably placed on the back side of the tiles by gluing. The connectors and controllers of the heating system are also mounted in the primary frame.

The water supply elements, such as servo valves, solenoid valves, control units, incoming hot and cold water pipes, etc., are placed at specific points of the primary frame.

The cable/pipeline connections formed on the primary frame always comprise a flexible part, which allows the flexible lines (e.g. electric cables, flexible corrugated ducts) and rigid lines (e.g. metal or plastic tubes) belonging to building service devices and other electronic/electrical devices can follow the small spatial displacements of the primary frame during the positioning of the primary frame, i.e. when moving it along three axes (translation, rotation).

The advantage of the modular wall structure according to the invention is that the cladding elements and building service units carried by the primary frame can be connected to the load-bearing wall of the building in one step using the moving system and the secondary frame. The moving system also allows to move each primary frame relative to the secondary frame in six degrees of freedom. A further advantage of the modular wall structure is that the primary frames can be positioned in a coordinated manner with respect to each other at the same time due to the distance-measuring sensors and a central computer, thereby achieving an alignment accuracy of one-hundredth of a millimeter for the primary frames and the devices they carry.

Another advantage of the modular wall structure according to the invention is that the individual primary frames, as well as the building service devices associated with them, can be easily replaced at any time, without dismantling the walls.

Furthermore, an advantageous feature of the modular wall structure according to the invention is that its assembling and disassembling is extremely fast, and also allows repair of the building service devices without damaging the expensive design cover, for example in case of repair or replacement of a building service device built behind a ceramic tile. In addition, the wall structure can be installed or dismantled partially or fully in an automated manner by using special-purpose robots. Compared to conventional techniques (e.g. mechanical works, tiling works, masonry works, etc.), the cost and time required for the entire mechanical and design installation can be reduced even down to a tenth, and it is also environmentally friendly. There is no need for extra building materials, as the wall itself, the design and the structural and mechanical system are all in one, so much less bricks and separating materials (e.g. plasterboard, pressed wood (OSB) etc.) are needed. In addition, less assembly materials (wires, pipes, etc.) must be used, since the panels can be manufactured in advance, based on the needs already defined in the plans, and thus errors or extra material requirements arising during installation can be completely avoided. Material costs can also be calculated more precisely and simply. The system greatly reduces the carbon footprint during the interior and mechanical design, this can be up to 40-90% depending on the size of the investment, the location of the investment and other parameters. Thus, general contracting can result in 7-15% less carbon emissions.

Summarizing the above, the modular wall structure according to the invention has the following main advantages compared to the conventional interior architectural solutions:

- short production time, but full satisfaction of individual needs (the basic system is a commercial off-the-shelf product, but it can be completely customized with thousands of materials and almost one hundred functions);
- fast installation (the installation time is just a minor portion of the time needed by the current state-of-the-art technologies, the time required to design the interior can be reduced by up to 80% using the technology according to the invention);
- quick replaceability (even during the project, in a short time);
- precise and accurate alignments according to the plans (fully automated positioning, immediate feedback to the designers)
- accurate material quantity and therefore better project planning and cost predictability (predefined component quantities);
- smaller carbon footprint (simpler logistics);
- use of structural elements that can be installed by means of robots, without human intervention, not only during the mounting process, but also during the installation of the entire system;
- full BIM (building information modelling) and CAD integration, which means that planning, installation and operation can be monitored and measured in 100% during the entire life cycle.

The invention claimed is:

1. A modular wall structure comprising multiple primary frames (10) for carrying cladding elements (11) and building service devices (12), a secondary frame (20) for supporting the primary frames (10), and a moving system (4) for moving each primary frame (10) with respect to the secondary frame (20) in six degrees of freedom, characterized by that the moving system (4) comprises at least three moving units (40) for each primary frame (10), wherein each moving unit (40) comprises a housing (50) attached to the primary frame (10), a spherical joint bushing (61) inside the housing (50), wherein said joint bushing (61) can be translated parallel to the plane of the primary frame (10), a first drive unit (72) attached to the primary frame (10) for moving the ball joint bushing (61) relative to the housing (50) along a first direction (x) by means of a first shaft (70), a second drive unit (82) attached to the primary frame (10) for moving the ball joint bushing (61) relative to the housing (50) along a second direction (y) perpendicular to the first direction (x) through a second axis (80), and a third drive unit (92) attached to the secondary frame (20) for moving the ball joint bushing (61) relative to the secondary frame (20) in a third direction (z) perpendicular to both the first direction (x) and the second direction (y), through a third shaft (90), wherein a free end (71) of the first shaft (70) is slidably mounted into a first guide groove (62) of the ball joint bushing (61), said first guide groove (62) extending in the second direction (y), wherein a free end (81) of the second shaft (80) is slidably mounted in a second guide groove (63) of the ball joint bushing (61), said second guide groove (63) extending in the first direction (x), and wherein a free end of the third shaft (90) is mounted into a ball joint (60) rotatably arranged in said ball joint bushing (61).

2. The modular wall structure according to claim 1, characterized by that the first drive unit (72) is configured to move the first shaft (70) along a straight line in the first direction (x), and the second drive unit (82) is configured to move the second shaft (80) along a straight line in the second direction (y).

3. The modular wall structure according to claim 1, characterized by that the third shaft (90) is connected to the ball joint (60) by screw threads, and the third drive unit (92) is configured to rotate the third axis (90) in one place for moving the housing (50) along the third direction (z).

4. The modular wall structure according to claim 1, characterized by that the secondary frame (20) is provided with fastening elements (21) for fastening to a load-bearing wall of a building.

5. The modular wall structure according to claim 1, characterized by that the primary frame (10) is provided with fastening elements for fixing building service devices (12) and/or electronic devices on a first side thereof facing the secondary frame (20), and on the side opposite to the first side, said primary frame (10) it is provided with fastening elements for fixing cladding elements (11).

6. The modular wall structure according to claim 1, characterized by that laser distance-measuring sensors (13) connected to a central computer via signal lines are arranged on the second side of the primary frame (10).

* * * * *